US009781531B2

(12) United States Patent
Sun et al.

(10) Patent No.: US 9,781,531 B2
(45) Date of Patent: Oct. 3, 2017

(54) MICROPHONE SYSTEM AND RELATED CALIBRATION CONTROL METHOD AND CALIBRATION CONTROL MODULE

(71) Applicant: MEDIATEK INC., Hsin-Chu (TW)

(72) Inventors: Liang-Che Sun, Taipei (TW); Yiou-Wen Cheng, Hsinchu (TW)

(73) Assignee: MEDIATEK INC., Hsin-chu (TW)

( * ) Notice: Subject to any disclaimer, the term of this patent is extended or adjusted under 35 U.S.C. 154(b) by 748 days.

(21) Appl. No.: 13/684,593

(22) Filed: Nov. 26, 2012

(65) Prior Publication Data

US 2014/0146972 A1 May 29, 2014

(51) Int. Cl.

| | |
|---|---|
| ***H04R 29/00*** | (2006.01) |
| *H04R 1/40* | (2006.01) |
| *H04R 3/00* | (2006.01) |

(52) U.S. Cl.

CPC ..... *H04R 29/006* (2013.01); *H04R 1/406* (2013.01); *H04R 3/005* (2013.01)

(58) Field of Classification Search

CPC .. H04R 29/006; H04R 29/005; H04R 29/004; H04R 1/406; H04R 3/005; H04S 7/301

USPC ..... 381/58, 56, 122, 92, 26, 103, 170

See application file for complete search history.

(56) References Cited

U.S. PATENT DOCUMENTS

| | | | | |
|---|---|---|---|---|
| 8,009,840 | B2 | 8/2011 | Kellermann | |
| 8,064,617 | B2 | 11/2011 | Buck | |
| 2003/0147538 | A1* | 8/2003 | Elko | H04R 3/005 381/92 |
| 2004/0252845 | A1* | 12/2004 | Tashev | 381/56 |
| 2005/0018861 | A1* | 1/2005 | Tashev | H04R 1/406 381/92 |
| 2009/0175466 | A1* | 7/2009 | Elko et al. | 381/94.2 |
| 2010/0017205 | A1* | 1/2010 | Visser et al. | 704/225 |
| 2010/0191143 | A1* | 7/2010 | Ganter et al. | 600/559 |

OTHER PUBLICATIONS

O. Hoshuyama et al., "A Realtime Robust Adaptive Microphone Array Controlled by an SNR Estimate," IEEE Proceedings of ICASSP, Apr. 1998, pp. 3604-3608.*

* cited by examiner

*Primary Examiner* — Vivian Chin
*Assistant Examiner* — Con P Tran
(74) *Attorney, Agent, or Firm* — Winston Hsu

(57) ABSTRACT

An embodiment of the invention provides a calibration control method performed by a microphone system. The microphone system includes a plurality of microphones configured to generate a plurality of microphone signals. First, the microphone system equalize the microphone signals to generate a plurality of equalized microphone signals. Next, the microphone system calculates a set of similarity indicators based on the equalized microphone signals. Then, the microphone system compares the set of similarity indicators with a set of predetermined thresholds to determine whether to calibrate the microphone signals.

19 Claims, 3 Drawing Sheets

MICROPHONE SYSTEM AND RELATED CALIBRATION CONTROL METHOD AND CALIBRATION CONTROL MODULE

BACKGROUND

1. Technical Field

The invention relates generally to microphone systems, and more particularly, to calibration of microphone systems.

2. Related Art

A microphone system with an array of microphones has several useful applications. For example, the microphone system may suppress interference and enhance a target speech that enters the microphone array from a specific direction of arrival. Whatever the application is, the microphone system's performance may deteriorate if the microphone array has a gain mismatch and the mismatch remains unresolved. A gain mismatch exists if, instead of having gains that are identical, the microphones' gains are different. To ensure the microphone system's performance, the gain mismatch should be calibrated properly.

SUMMARY

An embodiment of the invention provides a calibration control method performed by a microphone system. The microphone system includes a plurality of microphones configured to generate a plurality of microphone signals. First, the microphone system equalize the microphone signals to generate a plurality of equalized microphone signals. Next, the microphone system calculates a set of similarity indicators based on the equalized microphone signals. Then, the microphone system compares the set of similarity indicators with a set of predetermined thresholds to determine whether to calibrate the microphone signals.

Another embodiment of the invention provides a microphone system. The microphone system includes a microphone array, a calibration module, and a calibration control module. The microphone array includes a plurality of microphones configured to generate a plurality of microphone signals. The calibration module is coupled to the microphone array and configured to calibrate the microphone signals selectively. The calibration control module includes a gain equalizer, a similarity calculator, and a comparator. The gain equalizer is coupled to the microphone array and configured to equalize the microphone signals to generate a plurality of equalized microphone signals. The similarity calculator is coupled to the gain equalizer and configured to calculate a set of similarity indicators based on the equalized microphone signals. The comparator is coupled to the similarity calculator and the calibration module and configured to compare the set of similarity indicators with a set of predetermined thresholds and control the calibration module accordingly.

Still another embodiment of the invention provides a calibration control module. The calibration control module includes a gain equalizer, a similarity calculator, and a comparator. The gain equalizer is configured to equalize a plurality of microphone signals generated by a plurality of microphones of a microphone system to generate a plurality of equalized microphone signals. The similarity calculator is coupled to the gain equalizer and configured to calculate a set of similarity indicators based on the equalized microphone signals. The comparator is coupled to the similarity calculator and configured to compare the set of similarity indicators with a set of predetermined thresholds to determine whether to cause the microphone signals to be calibrated.

Other features of the present invention will be apparent from the accompanying drawings and from the detailed description which follows.

BRIEF DESCRIPTION OF THE DRAWINGS

The invention is fully illustrated by the subsequent detailed description and the accompanying drawings, in which like references indicate similar elements.

DETAILED DESCRIPTION

Figure 1:
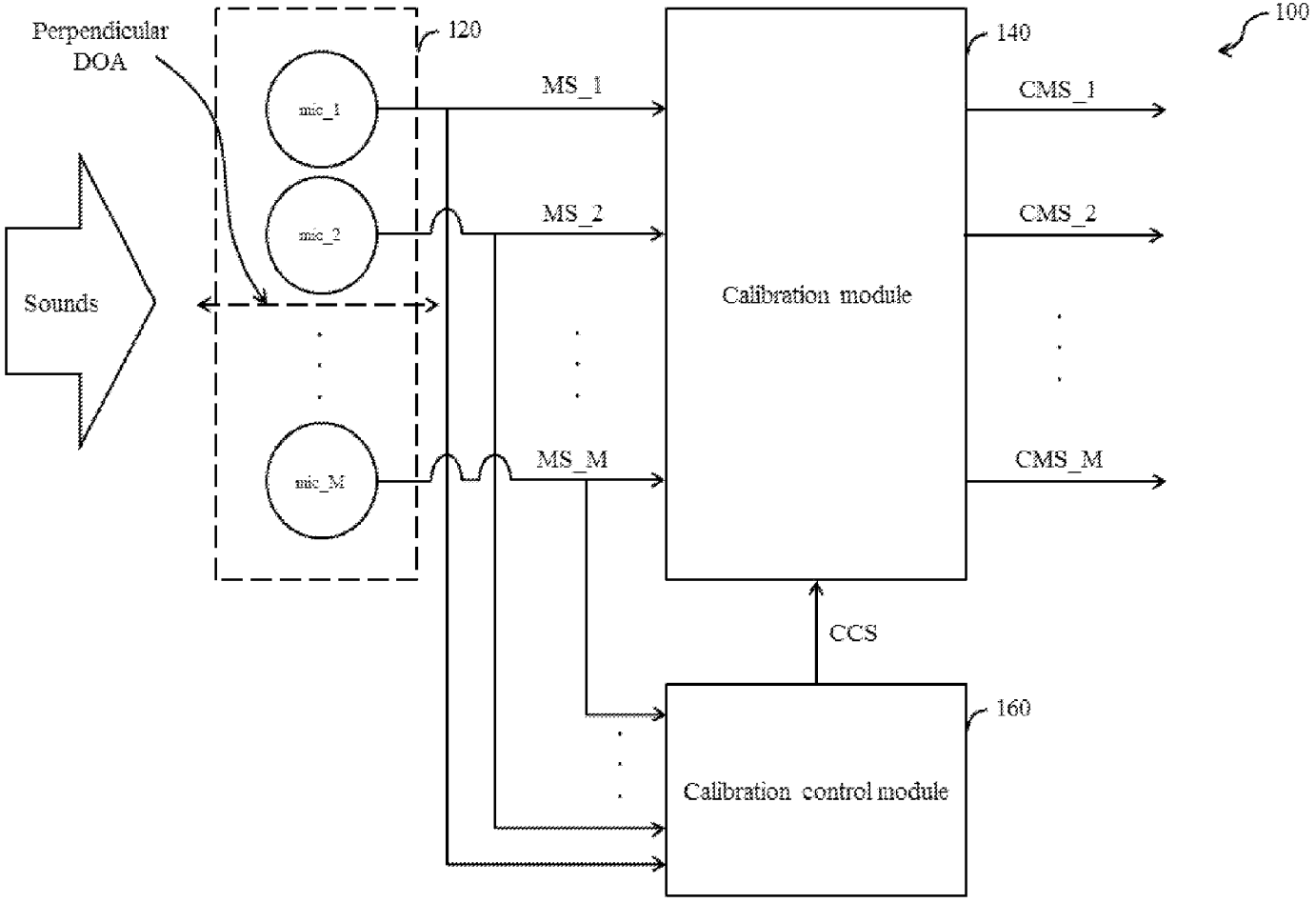
FIG. 1 shows a simplified block diagram of a microphone system according to an embodiment of the invention.

FIG. 1 shows a simplified block diagram of a microphone system 100 according to an embodiment of the invention. This microphone system 100 includes a microphone array 120, a calibration module 140, and a calibration control module 160. The microphone array 120 has M microphones, including mic_1, mic_2, . . . and mic_M, where M is a positive integer greater than one. These M microphones generate M microphone signals designated as MS_1, MS_2, . . . and MS_M, respectively. The microphone array 120 may have a gain mismatch. That is, instead of having gains that are all the same, the M microphones' gains may be different.

The calibration module 140 may selectively calibrate the M microphone signals to generate M calibrated microphone signals, including CMS_1, CMS_2, . . . and CMS_M. To name a few examples, the calibration module 140 may perform calibration using adaptive filters or through statistical normalization such as power normalization.

Generally speaking, the calibration module 140 may perform calibration if the microphone array 120 is receiving desired sounds. For example, the desired sounds may have a direction of arrival (DOA) that is identical to or close to a perpendicular DOA of the microphone array 120. On the other hand, if the microphone array 120 is not receiving desired sounds, the calibration module 140 should halt calibration; otherwise, the calibration module 140 may deteriorate the microphone system 100's performance. To ensure proper operations, the calibration module 140 may perform or halt calibration based on a calibration control signal CCS provided by the calibration control module 160.

The calibration control mechanism is complex, given the reality that there is frequently a microphone mismatch with an unknown extent. Specifically, with such an unknown microphone mismatch, it's difficult to determine the DOA of received sounds and whether or not the received sounds are desired.

Figure 2:
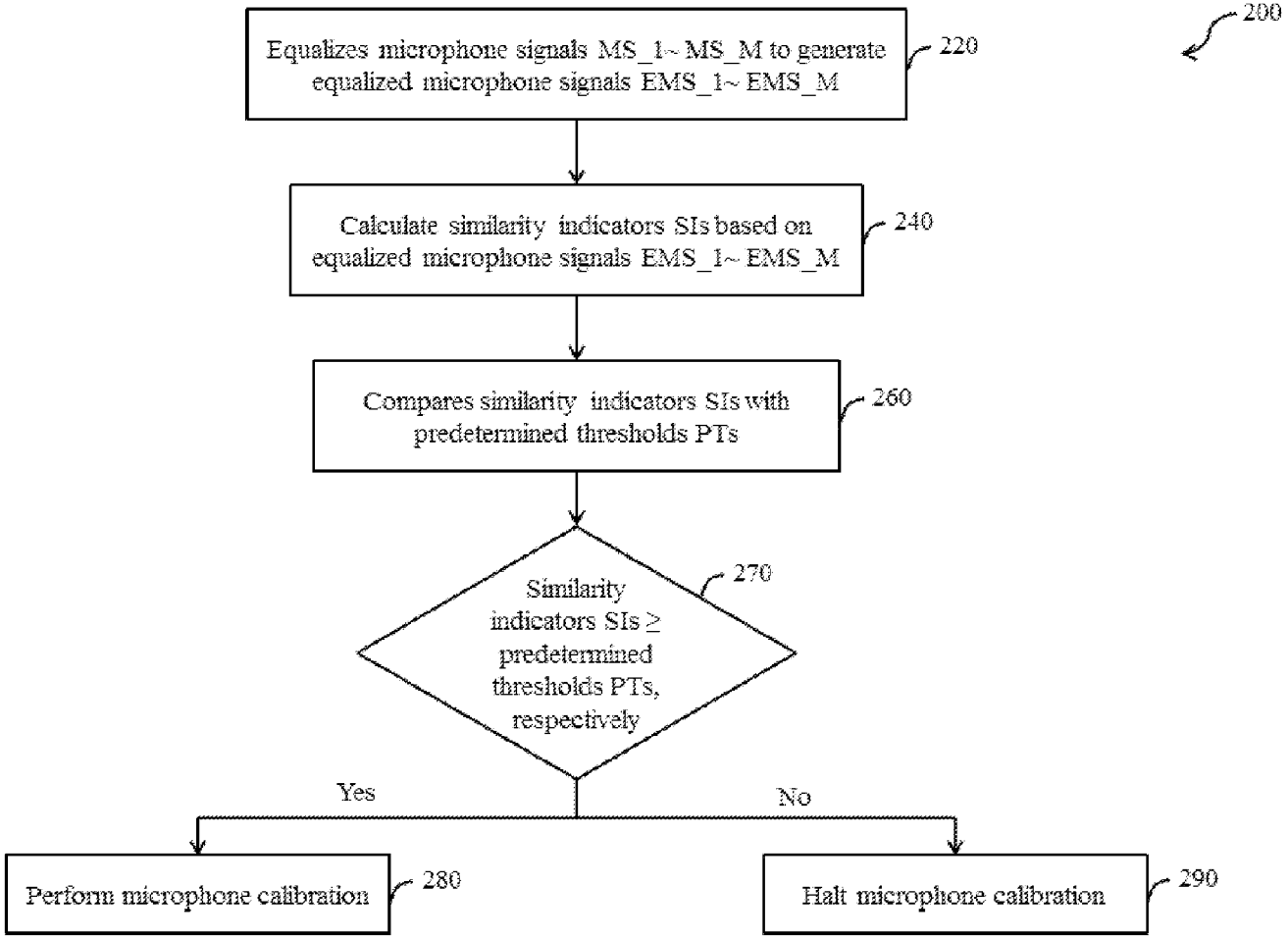
FIG. 2 shows a simplified flowchart of a calibration control method 200 to enable or disable the calibration module 140 of FIG. 1.
Figure 3:
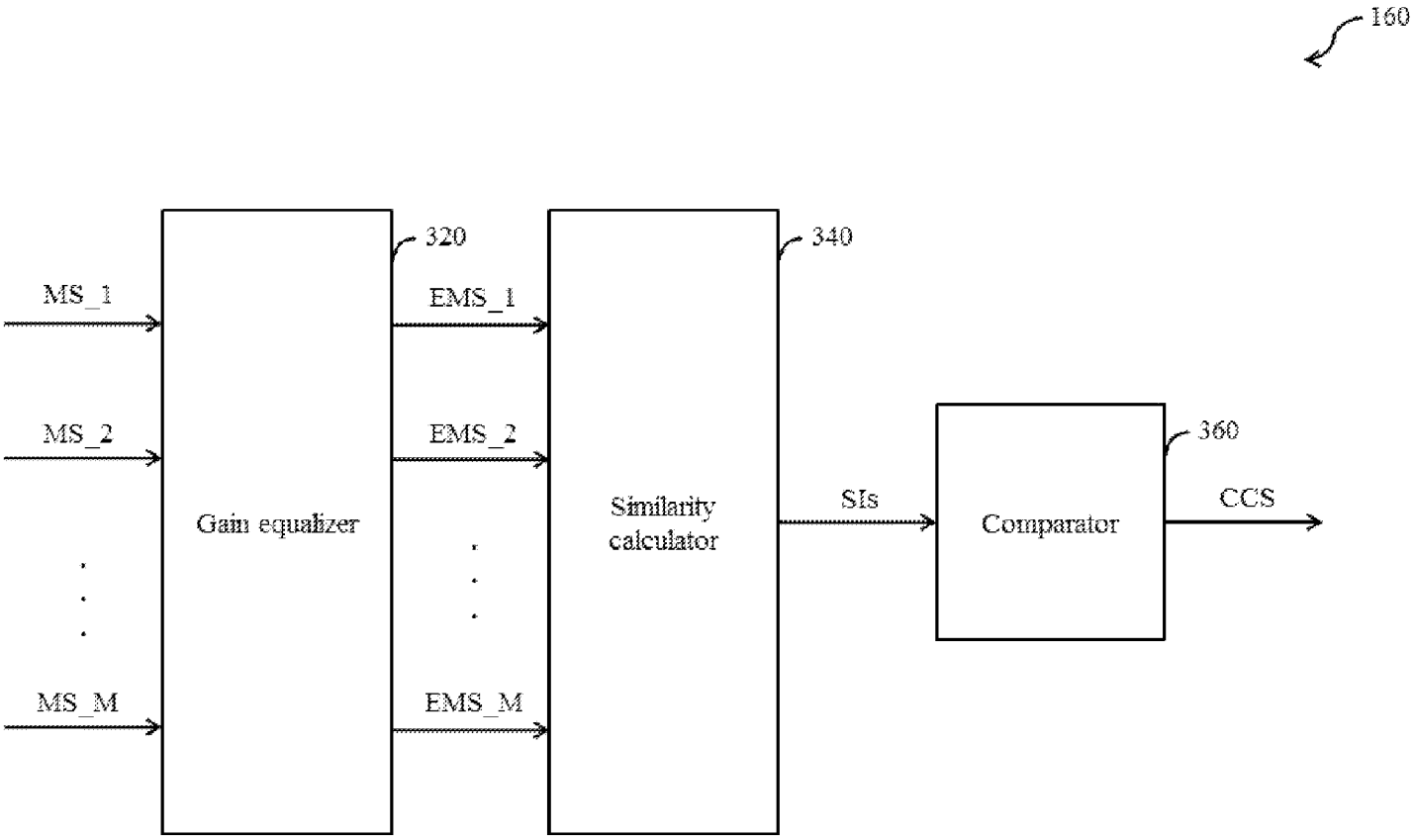
FIG. 3 shows a simplified block diagram of the calibration control module of the microphone system of FIG. 1 according to an embodiment of the invention.

FIG. 2 shows a simplified flowchart of a calibration control method 200 to enable or disable the calibration module 140 of FIG. 1. When enabled, the calibration module 140 performs the calibration operation; when disabled, the calibration module 140 halts the calibration operation. To help the microphone system 100 perform the calibration control method 200 or another calibration control method, the calibration control module 160 may include the components shown in FIG. 3. In the embodiment shown in FIG. 3, the calibration control module 160 includes a gain equalizer 320, a similarity calculator 340, and a comparator 360. The comparator 360 may generate the aforementioned calibration control signal CCS and use it to control the calibration module 140's operations.

At step 220, the gain equalizer 320 equalizes the M microphone signals MS_1~MS_M to generate M equalized microphone signals EMS_1~EMS_M, respectively. This step may remove some of the power discrepancy among the microphone signals MS_1~MS_M while retain some of the timing/phase discrepancy. Compared to the microphone signals MS_1~MS_M, the equalized microphone signals EMS_1~EMS_M may be less affected by the gain mismatch among the microphone array 120.

For example, the gain equalizer 320 may conduct step 220 through power normalization. Specifically, the gain equalizer 320 may calculate a raw gain factor $G_i(n)$ for microphone signal MS_i at time n based on the following equation:

$$G_i(n) = \sqrt{\frac{\sum_{j=1}^{M} P_j(n)/M}{P_i(n)}},$$

where $P_i(n)$ and $P_j(n)$ are the power level of microphone signals MS_i and MS_j at time n, and i and j are positive integers less than or equal to M.

In one embodiment, the microphone signal MS_i is divided into several frequency bands. The gain equalizer 320 may be implemented to equalize all the frequency bands of microphone signal MS_i with the same gain factor $G'_i(n)$ at time n, or equalize each of the frequency bands with its specific gain factor.

In another embodiment, in order to deal with the time delay, the gain equalizer 320 may smooth the raw gain factor $G_i(n)$ using the following first order IIR (Infinite Impulse Response) filter:

$$G'_i(n)=\alpha\times G'_i(n-1)+(1-\alpha)\times G_i(n),$$

wherein $G'_i(n-1)$ is the smoothed gain factor for microphone signal MS_i at time n−1, and $G'_i(n)$ is the smoothed gain factor for microphone signal MS_i at time n. For example, the adaption parameter α of the IIR filter may be equal to 0.97.

At step 240, the similarity calculator 340 calculates a set of similarity indicators SIs based on the M equalized microphone signals EMS_1~EMS_M. As uses herein, the set of similarity indicators SIs may include one or a plurality of members; for example, there may be only one similar indicator SI or multiple similar indicators SIs. Each of the similarity indicators SIs may represent how similar the M equalized microphone signals EMS_1~EMS_M are to each other on a given frequency band. For example, the greater the similarity indicator SI, the more the M equalized microphone signals EMS_1~EMS_M resemble each other on the given frequency band. Each of the frequency band may include only one frequency bin or multiple frequency bins.

For example, the set of similarity indicators SIs may include a first similarity indicator $SI_{500}$ for a first frequency band that encompasses 500 Hz, a second similarity indicator $SI_{1000}$ for a second frequency band that encompasses 1000 Hz, and a third similarity indicator $SI_{1500}$ for a third frequency band that encompasses 1500 Hz. Taking the first similarity indicator $SI_{500}$ as an example, it may be a power ratio (PR) of a fixed beamformer (FBF) output of the equalized microphone signals EMS_1~EMS_M in the first frequency band to a blocking matrix (BM) output of the equalized microphone signals EMS_1~EMS_M in the first frequency band. For example, if M is equal to two, $SI_{500}$ may be as follows:

$$SI_{500} = \frac{E[(\text{EMS_1}_{500} + \text{EMS_2}_{500})^2]}{E[(\text{EMS_1}_{500} - \text{EMS_2}_{500})^2]},$$

where E stands for the mathematical operation of expectation/average, $\text{EMS_1}_{500}$ stands for the part of the equalized microphone signal EMS_1 in the first frequency band, and $\text{EMS_2}_{500}$ stands for the part of the equalized microphone signal EMS_2 in the first frequency band. Apparently, $SI_{1000}$ and $SI_{1500}$ may have similar definitions.

In one embodiment, at step 260 and 270, the comparator 360 compares the set of similarity indicators SIs with a set of predetermined thresholds PTs, respectively, so as to determine whether each of the similarity indicators SIs is greater than or equal to the corresponding predetermined thresholds PTs. For example, the set of predetermined thresholds PTs may include a first predetermined threshold $PT_{500}$ to be compared with the first similarity indicator $SI_{500}$, a second predetermined threshold $PT_{1000}$ to be compared with the second similarity indicator $SI_{1000}$, and a third predetermined threshold $PT_{1500}$ to be compared with the third similarity indicator $SI_{1500}$. The calibration control module 160 may control the calibration module 140 to perform the calibration function if each of the similarity indicators SIs is greater than or equal to its corresponding predetermined threshold PT, at step 280. In other words, the calibration module 140 may calibrate the microphone signals MS_1~MS_M if $SI_{500}$, $SI_{1000}$, and $SI_{1500}$ are greater than or equal to $PT_{500}$, $PT_{1000}$, and $PT_{1500}$, respectively. Otherwise, the calibration control module 160 may control the calibration module 140 to halt calibration, at step 290.

Taking the similarity indicator $SI_{500}$ as an example and assuming that M is equal to two, the similarity indicator $SI_{500}$ may be formulated as follows:

$$SI_{500} = \frac{E[(\text{EMS_1}_{500} + \text{EMS_2}_{500})^2]}{E[(\text{EMS_1}_{500} - \text{EMS_2}_{500})^2]} = \frac{[(1+\cos(2\pi f\tau)]^2 + [(\sin(2\pi f\tau)]^2}{[(1-\cos(2\pi f\tau)]^2 + [(\sin(2\pi f\tau)]^2},$$

where $$\tau = \frac{d\cdot\sin\theta}{\text{sound_velocity}},$$

f is the sound's frequency (500 Hz in this example), τ is the phase delay between $\text{EMS_1}_{500}$ and $\text{EMS_2}_{500}$, d is the distance between the microphones mic_1 and mic_2, and θ is the difference between the received sound's DOA and the perpendicular DOA of the microphone array 120.

The aforementioned equation allows the predetermined thresholds PTs to be determined according to the expected coming angle of desired sounds and the maximum angular deviation that may be caused by microphone mismatch. For example, theoretically the gain mismatch among the microphone array 120 may result in no more than 7° of angular deviation in θ, and no more than 10° of phase deviation in τ. Under such an assumption, the predetermined thresholds $PT_{500}$, $PT_{1000}$, and $PT_{1500}$ may be set to 140, 35, and 15, respectively. Of cause, the set of predetermined thresholds PTs may be set to other values under other assumptions.

At step 280, because the comparator 360 has determined that the similarity indicators SIs are greater than or equal to their corresponding predetermined thresholds PTs, respectively, the calibration control module 160 controls the calibration module 140 to perform calibration. At step 290, because the comparator 360 has determined that at least one of the similarity indicators SIs is less than its corresponding predetermined threshold PT, the comparator 360 control the calibration module 140 to halt calibration.

Method 200 shown in FIG. 2 may be iterative. For example, after step 280 or 290, the calibration control module 160 may return to step 220 to perform method 200 all over again.

The aforementioned embodiments have several advantages. To name a few, the embodiments may correctly determine when and when not to perform microphone calibration even though the microphone array 120 may inevitably have a gain mismatch of an unknown extent. This is because the similarity calculator 340 and the comparator 360 determine whether to enable calibration by examining the equalized microphone signals EMS_1~EMS_M rather than the microphone signals MS_1~MS_M. Compared to the microphone signal MS_1~MS_M, the equalized microphone signals EMS_1~EMS_M may be less affected by the microphone array 120's gain mismatch. In addition, proper microphone calibration may be performed even after the microphone system 100 has been shipped from its manufacturer/vender and is in an end-user's possession. This may relieve some of the burden on the manufacturer/vender in calibrating the microphone system 100, and may help the microphone system 100 to maintain its performance even if the unknown gain mismatch changes with time. Furthermore, an adaptive filter, such as an adaptive finite impulse response (FIR) filter, is no longer needed for the calibration control module 160 and hence may avoid unpredictable divergence that might be caused by the adaptive filter's unstable estimation.

In the foregoing detailed description, the invention has been described with reference to specific exemplary embodiments thereof. It will be evident that various modifications may be made thereto without departing from the spirit and scope of the invention as set forth in the following claims. The detailed description and drawings are, accordingly, to be regarded in an illustrative sense rather than a restrictive sense.

What is claimed is:

1. A calibration control method performed by a microphone system, the microphone system comprising a plurality of microphones configured to generate a plurality of microphone signals, the calibration control method comprising:

equalizing the microphone signals to generate a plurality of equalized microphone signals comprising a first equalized microphone signal and a second equalized microphone signal;

calculating a set of similarity indicators based on the equalized microphone signals, wherein one of the set of similarity indicators is calculated according to the first equalized microphone signal at a first specific frequency band and the second equalized microphone signal at the first specific frequency band; and comparing the set of similarity indicators with a set of predetermined thresholds to determine whether to calibrate the microphone signals;

wherein another of the set of similarity indicators is calculated according to the first equalized microphone signal at a second specific frequency band and the second equalized microphone signal at the second specific frequency band; the set of the predetermined thresholds comprises a first predetermined threshold corresponding to the first specific frequency band and a second predetermined threshold corresponding to the second specific frequency band; and the step of comparing the set of similarity indicators with the set of predetermined thresholds comprises:

comparing said one of the set similarity indicators with the first predetermined threshold, and comparing said another of the set similarity indicators with the second predetermined threshold.

2. The calibration control method of claim 1, wherein the step of equalizing the microphone signals to generate the equalized microphone signals comprises:

applying a power normalization to the microphone signals to generate the equalized microphone signals.

3. The calibration control method of claim 1, wherein the step of equalizing the microphone signals to generate the equalized microphone signals comprises:

calculating a plurality of raw gain factors based on the microphone signals;

smoothing the raw gain factors to generate a plurality of smoothed gain factors; and applying the smoothed gain factors to the microphone signals to generate the equalized microphone signals.

4. The calibration control method of claim 1, wherein each of the set of similarity indicators is a power ratio of the equalized microphone signals in a frequency band.

5. The calibration control method of claim 4, wherein the power ratio is a ratio of a fixed beamformer output of the equalized microphone signals in the frequency band to a blocking matrix output of the equalized microphone signals in the frequency band.

6. The calibration control method of claim 1, further comprising:

calibrating the microphone signals if each of the set of similarity indicators is greater than or equal to a corresponding one of the set of predetermined thresholds.

7. The calibration control method of claim 1, wherein the set of predetermined thresholds is determined according to an expected coming angle and a maximum angular deviation.

8. A microphone system, comprising:

a microphone array, comprising a plurality of microphones configured to generate a plurality of microphone signals;

a calibration module, coupled to the microphone array, configured to calibrate the microphone signals selectively; and a calibration control module, coupled to the microphone array and the calibration module, comprising:

a gain equalizer, coupled to the microphone array, configured to equalize the microphone signals to generate a plurality of equalized microphone signals comprising a first equalized microphone signal and a second equalized microphone signal;

a similarity calculator, coupled to the gain equalizer, configured to calculate a set of similarity indicators based on the equalized microphone signals; and a comparator, coupled to the similarity calculator and the calibration module, configured to compare the set of similarity indicators with a set of predetermined thresholds and control the calibration module accordingly, wherein one of the set of similarity indicators is calculated according to the first equalized microphone signal at a first specific frequency band and the second equalized microphone signal at the first specific frequency band;

wherein another of the set of similarity indicators is calculated according to the first equalized microphone signal at a second specific frequency band and the second equalized microphone signal at the second specific frequency band; the set of the predetermined thresholds comprises a first predetermined threshold corresponding to the first specific frequency band and a second predetermined threshold corresponding to the second specific frequency band; and the comparator compares said one of the set similarity indicators with the first predetermined threshold, and compares said another of the set similarity indicators with the second predetermined threshold.

9. The microphone system of claim 8, wherein the gain equalizer is configured to:

apply a power normalization to the microphone signals to generate the equalized microphone signals.

10. The microphone system of claim 8, wherein the gain equalizer is configured to:

calculate a plurality of raw gain factors based on the microphone signals;

smooth the raw gain factors to generate a plurality of smoothed gain factors; and apply the smoothed gain factors to the microphone signals to generate the equalized microphone signals.

11. The microphone system of claim 8, wherein each of the set of similarity indicators is a power ratio of the equalized microphone signals in a frequency band.

12. The microphone system of claim 11, wherein the power ratio is a ratio of a fixed beamformer output of the equalized microphone signals in the frequency band to a blocking matrix output of the equalized microphone signals in the frequency band.

13. The microphone system of claim 8, wherein the comparator is configured to:

control the calibration module to calibrate the microphone signals if each of the set of similarity indicators is greater than or equal to a corresponding one of the set of predetermined thresholds.

14. A calibration control module, comprising:

a gain equalizer, configured to equalize a plurality of microphone signals generated by a plurality of microphones of a microphone system to generate a plurality of equalized microphone signals comprising a first equalized microphone signal and a second equalized microphone signal;

a similarity calculator, coupled to the gain equalizer, configured to calculate a set of similarity indicators based on the equalized microphone signals, wherein one of the set of similarity indicators is calculated according to the first equalized microphone signal at a first specific frequency band and the second equalized microphone signal at the first specific frequency band; and a comparator, coupled to the similarity calculator, configured to compare the set of similarity indicators with a set of predetermined thresholds to determine whether to cause the microphone signals to be calibrated;

wherein another of the set of similarity indicators is calculated according to the first equalized microphone signal at a second specific frequency band and the second equalized microphone signal at the second specific frequency band; the set of the predetermined thresholds comprises a first predetermined threshold corresponding to the first specific frequency band and a second predetermined threshold corresponding to the second specific frequency band; and the comparator compares said one of the set similarity indicators with the first predetermined threshold, and compares said another of the set similarity indicators with the second predetermined threshold.

15. The calibration control module of claim 14, wherein the gain equalizer is configured to:

apply a power normalization to the microphone signals to generate the equalized microphone signals.

16. The calibration control module of claim 14, wherein the gain equalizer is configured to:

calculate a plurality of raw gain factors based on the microphone signals;

smooth the raw gain factors to generate a plurality of smoothed gain factors; and apply the smoothed gain factors to the microphone signals to generate the equalized microphone signals.

17. The calibration control module of claim 14, wherein each of the set of similarity indicators is a power ratio of the equalized microphone signals in a frequency band.

18. The calibration control module of claim 17 wherein the power ratio is a ratio of a fixed beamformer output of the equalized microphone signals in the frequency band to a blocking matrix output of the equalized microphone signals in the frequency band.

19. The calibration control module of claim 14, wherein the comparator is configured to:

cause the microphone signals to be calibrated if each of the set of similarity indicators is greater than or equal to a corresponding one of the set of predetermined thresholds.

* * * * *